US007841106B2

(12) United States Patent
Farys

(10) Patent No.: US 7,841,106 B2
(45) Date of Patent: Nov. 30, 2010

(54) FOOTWEAR WITH IMPROVED TIGHTENING OF THE UPPER

(75) Inventor: Yves Farys, Saint-Jorioz (FR)

(73) Assignee: Salomon S.A.S., Metz-Tessy (FR)

( * ) Notice: Subject to any disclaimer, the term of this patent is extended or adjusted under 35 U.S.C. 154(b) by 835 days.

(21) Appl. No.: 11/519,065

(22) Filed: Sep. 12, 2006

(65) Prior Publication Data

US 2007/0068040 A1 Mar. 29, 2007

(30) Foreign Application Priority Data

Sep. 28, 2005 (FR) ..... 05 09919

(51) Int. Cl.
*A43C 11/00* (2006.01)
*A43C 7/00* (2006.01)

(52) U.S. Cl. ..... 36/50.1; 24/712.2

(58) Field of Classification Search ..... 36/50.1–54; 24/712.1–712.3
See application file for complete search history.

(56) References Cited

U.S. PATENT DOCUMENTS

| | | | | | |
|---|---|---|---|---|---|
| 749,569 | A | * | 1/1904 | Luks | 24/712.7 |
| 1,386,985 | A | | 8/1921 | Bowers | |
| 1,504,157 | A | * | 8/1924 | Sowers | 24/712 |
| 1,995,243 | A | | 3/1935 | Clarke | |
| 2,801,476 | A | * | 8/1957 | Farbeaux | 434/248 |
| 4,005,532 | A | | 2/1977 | Giese et al. | |
| 4,200,998 | A | * | 5/1980 | Adams | 36/50.1 |
| 4,331,731 | A | | 5/1982 | Seike et al. | |
| RE31,052 | E | | 10/1982 | Adams | |
| 4,507,878 | A | * | 4/1985 | Semouha | 36/50.1 |
| 5,467,537 | A | * | 11/1995 | Aveni et al. | 36/50.1 |
| 5,477,593 | A | | 12/1995 | Leick | |
| 5,532,039 | A | | 7/1996 | Payne et al. | |
| 5,566,474 | A | * | 10/1996 | Leick et al. | 36/50.1 |
| 5,637,389 | A | | 6/1997 | Colvin et al. | |
| 6,510,627 | B1 | * | 1/2003 | Liu | 36/50.1 |
| 6,701,590 | B2 | * | 3/2004 | Voughlohn | 24/712.2 |
| 6,880,271 | B2 | * | 4/2005 | Caeran | 36/54 |
| 6,941,683 | B2 | * | 9/2005 | Freed | 36/50.1 |
| 6,952,890 | B1 | * | 10/2005 | Blakeslee | 36/50.1 |
| 6,968,638 | B2 | * | 11/2005 | Gonzalez Palacio | 36/112 |
| 7,073,279 | B2 | * | 7/2006 | Min | 36/50.1 |
| 2003/0070323 | A1 | | 4/2003 | Johnson, Jr. | |
| 2005/0175799 | A1 | | 8/2005 | Farnworth | |
| 2006/0053658 | A1 | * | 3/2006 | Voughlohn | 36/50.1 |
| 2006/0185193 | A1 | * | 8/2006 | Pellegrini | 36/50.1 |

FOREIGN PATENT DOCUMENTS

| | | | |
|---|---|---|---|
| DE | 180 473 | C | 10/1905 |
| DE | 1 015 347 | B | 9/1957 |
| DE | 195 12 499 | C1 | 6/1996 |
| DE | 199 07 314 | A1 | 8/1999 |

(Continued)

*Primary Examiner*—Jila M Mohandesi
*Assistant Examiner*—Melissa L Lalli
(74) *Attorney, Agent, or Firm*—Greenblum & Bernstein, P.L.C.

(57) ABSTRACT

An article of footwear including a sole and an upper, a lateral quarter and a medial quarter. A device for tightening the upper includes a first lateral lace strand and at least two points for connecting the first lateral strand to the lateral quarter, as well as a first medial lace strand and at least two points for connecting the first medial strand to the medial quarter. Each lateral or medial strand includes a lateral intermediate portion or a medial intermediate portion, respectively, which extends between two connecting points of the same lateral or medial quarter, without being guided by a connecting point of the other lateral or medial quarter, a connector connecting the lateral and medial intermediate portions of the lateral and medial strands, respectively, the connector enabling the sliding of at least one of the lateral and medial strands.

31 Claims, 6 Drawing Sheets

FOREIGN PATENT DOCUMENTS

| | | | |
|---|---|---|---|
| FR | 616 991 | A | 2/1927 |
| FR | 2 706 743 | A1 | 12/1994 |
| FR | 2 785 506 | A1 | 5/2000 |
| WO | WO 9806288 | A1 * | 2/1998 |

* cited by examiner

Fig. 2a
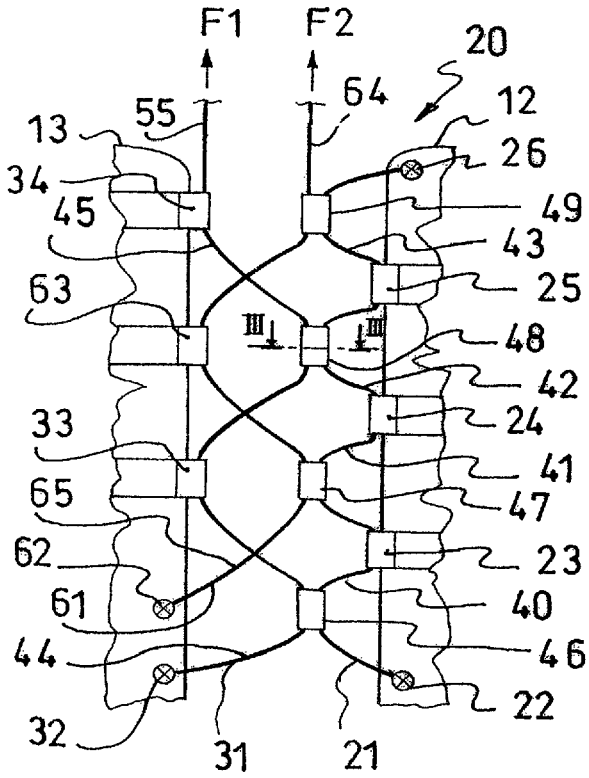
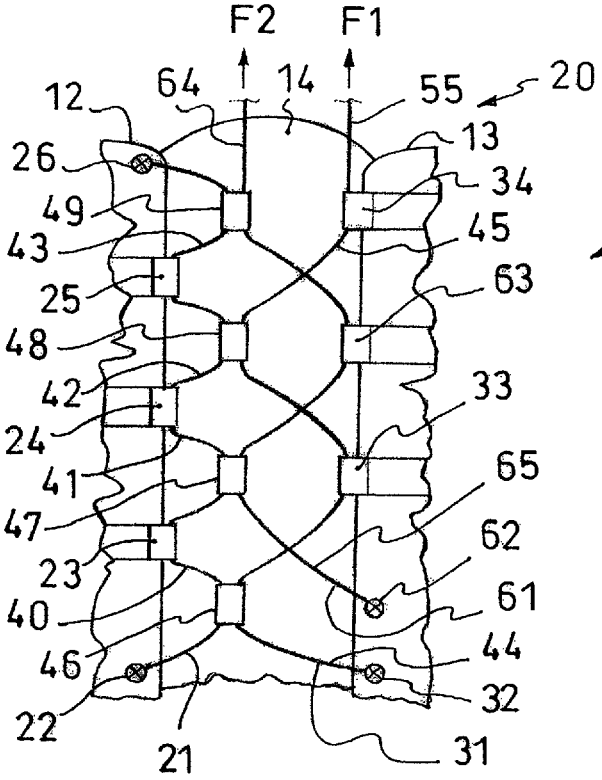
Fig. 2b

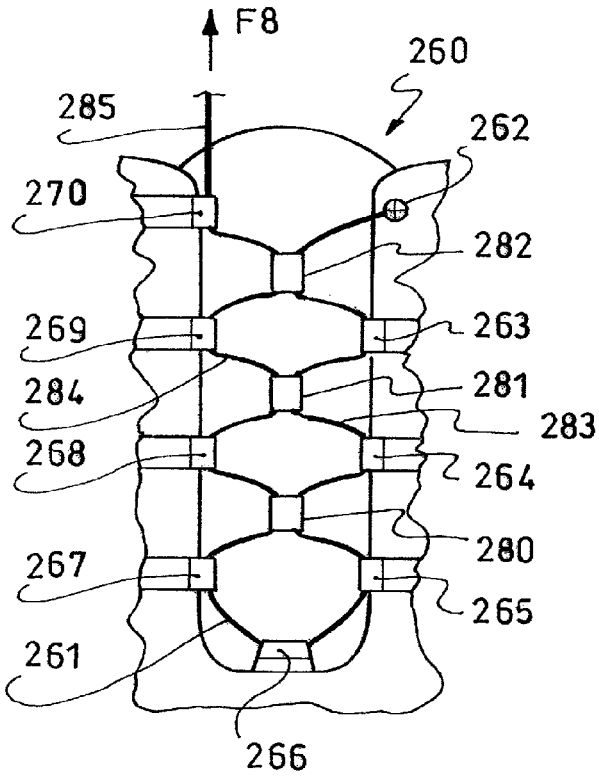
Fig: 10
Fig: 11
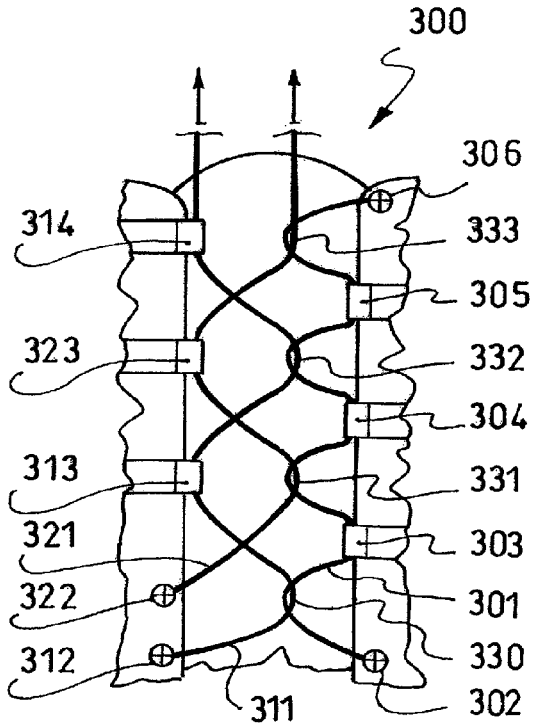

FOOTWEAR WITH IMPROVED TIGHTENING OF THE UPPER

CROSS-REFERENCE TO RELATED APPLICATION

This application claims priority under 35 U.S.C. §119 of French Patent Application No. 05.09919, filed on Sep. 28, 2005, the disclosure of which is hereby incorporated by reference thereto in its entirety.

BACKGROUND OF THE INVENTION

1. Field of the Invention

The invention relates to an article of footwear, such as a shoe, particularly a sports shoe, and more particularly a shoe adapted for running, race walking, or other athletic activities.

Articles of footwear of the aforementioned type can be used in fields such as walking or flat or mountain racing, hiking, or snowboarding, skiing, snowshoeing, roller skating, skateboarding, cycling, ball-playing sports, or the like.

2. Description of Background and Relevant Information

An article of footwear can have a low upper or a high upper. Footwear can also be relatively flexible or, on the contrary, they can be more rigid. However, the wearer's foot, in any case, must be adequately held. Indeed, an adequate support of the foot in the upper allows the article of footwear to be put to its best use.

With a flexible low shoe, such as used for mountain running, for example, adequate support facilitates the rolling movement of the foot as well as the transmission of sensory information. In particular, a device for tightening the upper is adapted to hold at least the wearer's instep in the area of the vamp.

Traditionally, a tightening device includes a lace, on the one hand, and points for connecting the lace to the upper, on the other hand. These connecting points are defined by keepers or guides associated with lateral and medial quarters of the upper. The lace follows a path that leads it alternately from one quarter to the other. It thus suffices to pull on the lace to bring the quarters closer together and to tighten the upper. Next, the blocking of the lace maintains the lace in its tightened position. A first problem to be resolved by a good tightening device lies in adapting to various foot morphologies and in achieving comfort, that is, support without excessive pressure. Another problem involves maintaining the tightening comfort during use of the shoe, i.e., during walking or running.

In the static position, indeed, traction on the lace substantially tensions the lace in the area of the instep or in the area of the flexion crease, such as the flexion crease between the instep and the lower leg. There is, however, less tension toward the toes. Therefore, the tightening is generally more substantial toward the instep or the flexion crease than toward the toes. Thereafter, when walking or while engaging in a sporting activity, the deformations of the upper enable a balancing of the tensions along the lace. As a result, tightening is better distributed. However, it has been observed that the foot is not always properly supported, in the sense that this support is not sufficiently uniform along the shoe.

Certain portions of the foot are overly tightened while others are not sufficiently tightened; or a given portion of the foot is sometimes too tight, sometimes not tight enough.

In fact, during a walking cycle, the shape of the foot changes rapidly. Some portions alternately bend and straighten out. Sections of the foot may broaden out, and then narrow down, or they may thicken, and then thin down. The walking cycle is so fast that there is not enough time for the tensions in the lacing to balance completely. Thus, disparities remain in the distribution of the tightening of the upper of the shoe. Consequently, the foot is generally not completely held during use, since the tightening disparities reverberate on the foot.

SUMMARY OF THE INVENTION

The invention improves upon the retention of the user's foot within an article of footwear, such as a shoe or a boot. More particularly, the invention improves the distribution of tensions in a lace tightening device. Moreover, the invention improves the performance of a lace tightening device during static and/or dynamic use.

To this end, the invention includes an article of footwear having a sole and an upper, the upper including a lateral quarter, a medial quarter, and a device for tightening the upper, the tightening device including a first lateral lace strand and at least two points for connecting the first lateral lace strand to the lateral quarter, as well as a first medial lace strand and at least two points for connecting the first medial lace strand to the medial quarter.

Each lateral or medial strand of the lace of the article of footwear includes a lateral intermediate portion or a medial intermediate portion, respectively, which extends between two connecting points of the same lateral or medial quarter, without passing by, or being guided, by a connecting point of the other lateral or medial quarter, and it includes a connecting arrangement connecting the lateral and medial intermediate portions of the lateral and medial strands, respectively, the connecting arrangement enabling the sliding of at least one of the lateral and medial strands.

Rather than extending from one quarter to the other as is the case in the prior art, a lace strand extends alternately from one connecting point to one connector between two strands. Thus, the length of the strand that rubs on the upper is reduced. Moreover, because it enables the sliding of at least one of the strands, the connector is enabled to move slightly with respect to the strand during the walking cycle. The connector is also able to move with respect to the upper. Consequently, the tensions are balanced between the strands and within the strands. The connector is located where the tensions of the strands are balanced. This place is movable during the walking cycle. The sliding of the connector also makes it possible to better adapt to the various foot morphologies.

A resulting advantage is that the tightening of the upper and, therefore, the tightening of the foot, is more uniform. The uniformity is maintained statically, if the user is standing still, for example, as well as dynamically, that is, while walking or running. The distribution of tensions in the lace tightening device is thus improved.

BRIEF DESCRIPTION OF DRAWINGS

Other characteristics and advantages of the invention will be better understood from the description that follows, with reference to the annexed drawings showing, by way of non-limiting examples, how the invention can be embodied, and in which:

FIG. 2*a* is an alternative to the shoe of FIGS. 1 and 2, whereby the shoe has no tongue;

FIG. 2*b* is an alternative to the shoe of FIGS. 1 and 2, the shoe having the reverse architecture of the shoe of FIGS. 1, 2;

FIG. 10 is a partial schematic top view of a shoe according to a seventh embodiment of the invention;

FIG. 11 is a partial schematic top view of a shoe according to an eighth embodiment of the invention;

DETAILED DESCRIPTION OF THE INVENTION

The first embodiment described hereinafter relates more specifically to shoes for walking, or for flat or mountain running. However, the invention applies to other fields, such as those mentioned above.

The first embodiment is described with reference to FIGS. 1-3.

Figure 1:
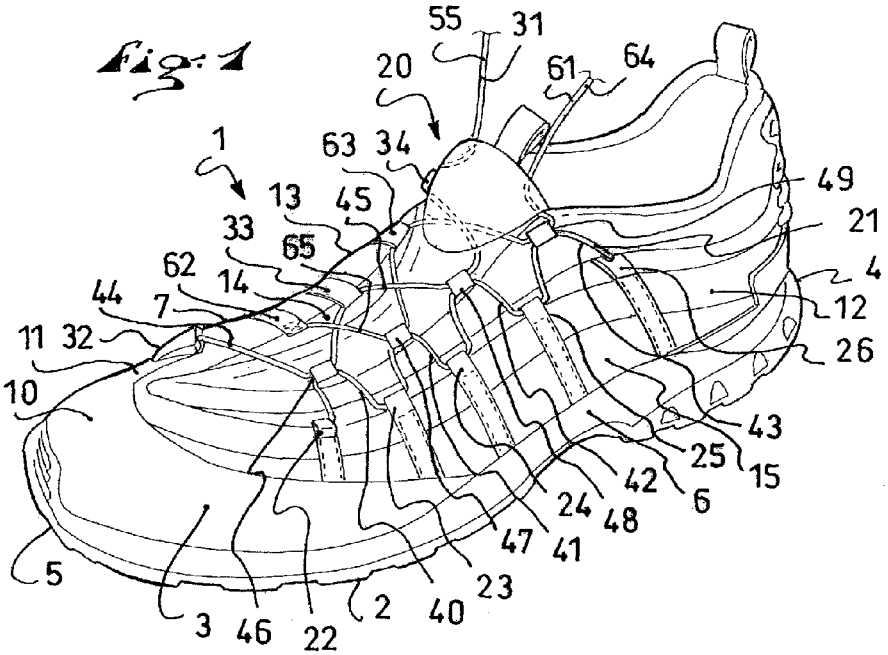
FIG. 1 is a front perspective view of a shoe according to a first embodiment of the invention.

As shown in FIG. 1, a running shoe is provided to receive the user's foot.

As is known, the shoe 1 includes a walking sole 2 and an upper 3. The shoe 1 extends lengthwise between a rear end or heel 4 and a front end or tip 5, and widthwise between a lateral side 6 and a medial side 7.

As shown, the upper 3 is a low upper which includes a portion 10 provided to surround the foot, with no top portion, i.e., no portion extending along the lower leg. For example, the low upper includes an upper edge that extends at or below the ankle of the wearer. Alternatively, however, the upper could be a high upper, i.e., provided also to extend along the lower leg.

The shoe 1 is structured so as to allow for a good foot rolling movement when walking, transmissions of sensory information, and impulses for supports or receptions. For these reasons, the sole 2 and upper 3 are relatively flexible.

However, the shoe could be provided to be more rigid in order to facilitate the use of the shoe in certain athletic fields, such as climbing or cycling, for example.

The upper 3 includes a top portion 11, or outer portion, that has a lateral quarter 12, a medial quarter 13, and a tongue 14. The tongue 14 connects the quarters 12, 13 to one another so as to provide the top portion 11 with continuity. However, the shoe could be produced without a tongue. In that case, the quarters 12, 13 can remain separated, as shown in FIG. 2*a*, or can be superimposed/overlapped.

The top portion 11 is affixed by its base 15 to the sole 2 in the area of the sole periphery. The top portion 11 of the upper is affixed to the sole 2 by gluing. However, another means, such as stitching, or the combination of gluing and stitching, could be utilized.

Figure 2:
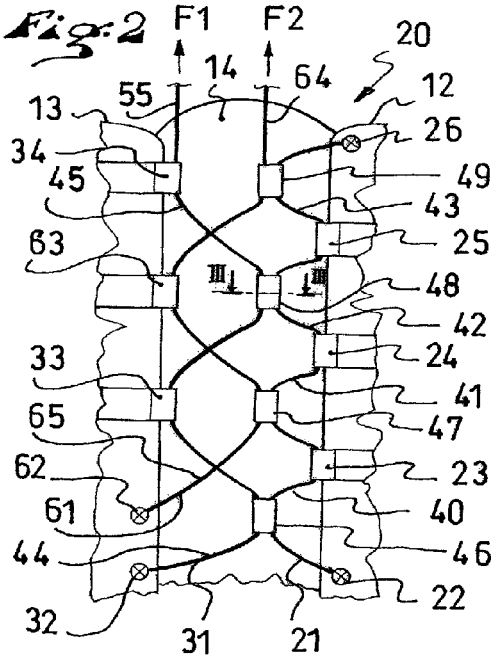
FIG. 2 is partial schematic top view of the shoe according to FIG. 1.

With reference to FIGS. 1 and 2, a first tightening device 20 is provided for reversibly tightening, i.e., tightening and untightening, the top portion 11 of the upper.

The first tightening device 20 includes a first lateral lace strand 21 and at least two points 22, 23, 24, 25, 26 for connecting the first lateral strand 21 to the lateral quarter 12. More specifically, the first embodiment of the invention provides first 22, second 23, third 24, fourth 25, and fifth 26 connecting points.

In an alternative embodiment, a number of connecting points other than five could be provided.

Similarly, the first tightening device 20 also includes a first medial lace strand 31 and at least two points 32, 33, 34 for connecting the first medial strand 31 to the medial quarter 13. More specifically, first 32, second 33, and third 34 connecting points are provided.

Here again, a number of connecting points other than three could be provided in an alternative embodiment.

According to the invention, each lateral strand 21 or medial strand 31 includes a lateral intermediate portion 40, 41, 42, 43 or a medial intermediate portion 44, 45, respectively, which extends between two connecting points of the same lateral 12 or medial 13 quarter, without being guided by a connecting point of the other lateral or medial quarter, and movable connectors 46, 47, 48, 49 connect the lateral intermediate 40, 41, 42, 43 and medial 44, 45 portions of the lateral and medial strands 21, 31, respectively, the movable connectors 46, 47, 48, 49 enabling the sliding of at least one of the lateral 21 and medial 31 strands. The movable connectors are constituted, for example, by a non-affixed keeper that is described below.

Thus, a lace strand alternately extends from a connecting point to a movable connector by sliding between two strands. The sliding of the connector promotes balancing of the tensions between the strands and within the strands.

According to the first embodiment of the invention, the first 22 and fifth 26 connectors, respectively, are fastening points in the area of the first lateral lace strand 21. This means that the lace strand 21 is affixed to the upper 3 at points 22 and 26 without being displaced. The strand is affixed, for example, by stitching, gluing, knotting, or by means of a blocker or by any other means.

Between the fastening points 22, 26, the second 23, third 24, and fourth 25 connecting points, respectively, are lace keepers/guides. According to the embodiment described, the keepers 23, 24, 25 include loops that are affixed to the upper 3, although they could also be in other forms, such as openings arranged in the upper 3, or the like.

From the first 22 up to the fifth 26 connecting point, and between two successive connecting points, the lateral strand 21 has first 40, second 41, third 42, and fourth 43 portions, respectively. Each portion 40, 41, 42, 43 is a subdivision of the strand 21.

It is provided that a portion 40, 41, 42, 43 is, on average, a bit longer than the distance between respective pairs of the connecting points 22, 23, 24, 25, 26. Thus, the portions 40, 41, 42, 43 are loops distributed between the fasteners 22, 26. Given that the lace strand 21 can slide within the keepers 23, 24, 25, the portions or loops 40, 41, 42, 43, respectively, can expand or narrow down. The expansion of one or several loops causes the narrowing of one or several other loops. The portions 40, 41, 42, 43 carry the movable connectors 46, 47, 48, 49 and serve as keepers with variable geometry for the medial lace strand 31.

In the same context, in the area of the first medial lace strand 31, the first connecting point 32 is a fastener, and the second 33 and third 34 connecting points are lace keepers/guides. The medial lace strand 31 extends, not only between the fastener 32 and the keepers 33, 34, but also beyond the keeper or third connecting point 34 by a free end 55.

From the first connecting point 32 up to the third connecting point 34, and between two successive connecting points, the medial strand 31 has first portion or loop 44 and second portion or loop 45, respectively. Here again, the strand 31 can slide in the keepers 33, 34, and the loops 44, 45 can expand or narrow down in order to enable the tightening of the upper, as will be further described below. Indeed, the free end 55 of the first strand 31 enables the user to exert a traction force in the direction of the arrow F1 for tightening. This force F1 tends to reduce the length of the loops 44, 45.

According to the first embodiment of the invention, the tightening device 20 of the shoe 1 further includes a second medial lace strand 61. This strand is connected to the upper 3 by a first connecting point 62 and a second connecting point 63.

Still in the same context, the first connecting point 62 of the second strand 61 is a fastener, and the second connecting point 63 is a keeper. The second medial lace strand 61 extends between the fastener 62 and the keeper 63, and also beyond the keeper or the second connecting point 63 by a free end 64.

Between the first connecting point 62 and the second connecting point 63, the second medial strand 61 has a first portion 65 or loop. Here again, the strand 61 can slide in the keeper 63, and the loop 65 can expand or narrow down.

As will be further described below, the free end 64 of the second strand 61 enables the user to exert a traction force in the direction of the arrow F2. This force F2 tends to reduce the length of the loop 65 between the points 62 and 63.

The respective connecting points of the first medial strand 31 and second medial strand 61 are alternately arranged on a quarter of the upper. Along the direction extending from the tip 5 toward the heel 4 are successively found the first point 32 of the first strand 31, the first point 62 of the second strand 61, the second point 33 of the first strand 31, the second point 63 of the second strand 61 and, finally, the third point 34 of the first strand 31. The various points 32, 62, 33, 63, 34 follow one another along a concave curve, as shown in FIG. 1. This observation is also valid for the connecting points 22-26 of the first lateral lace strand 21. The points 22-26 follow one another along a concave curve. FIG. 2 provides an aligned schematic view for reasons of convenience. However, one can indeed provide an alternative construction in which the points are more aligned.

The shoe 1 according to the first embodiment further includes the aforementioned movable connectors 46, 47, 48, 49 that connect a portion of a lateral strand 21 to a portion of a medial strand 31, 61, respectively. More specifically, a first connector 46 connects the first loop 40 of the first lateral strand 21 to the first loop 44 of the first medial strand 31. Next, a second connector 47 connects the second loop 41 of the first lateral strand 21 to the first loop 65 of the second medial lace strand 61. Then, a third connector 48 connects the third loop 42 of the first lateral strand 21 to the second loop 45 of the first medial strand 31. Finally, a fourth connector 49 connects the fourth loop 43 of the first lateral strand 21 to the free end 64 of the second medial lace strand 61.

The connectors 4649 follow one another in a direction extending from the tip 5 to the heel 4. These connectors 4649 alternately connect the first lateral lace strand 21 to the first medial lace strand 31 and to the second medial lace strand 61.

Each of the connectors 46, 47, 48, 49 enables a sliding of the lace strands 21, 31, 61 with which it is connected. Thus, the three strands 21, 31, 61 form a mesh-like assembly, each strand extending along a different path, in order to make the tightening of the top portion 11 of the upper 3 more uniform. In this regard, the shoe 1 includes a tightening zone defined by the lateral connecting points 22, 23, 24, 25, 26, the medial connecting points 32, 62, 33, 63, 34, and the movable connectors 46, 47, 48, 49, with the tightening of the upper being achieved by application of a traction force applied to the lace strand portions 55, 64 that are located outside of, or beyond, the tightening zone. In the illustrated embodiment, the lace strand portions 55, 64 extend rearwardly beyond the tightening zone. Connecting points 22, 32 are the forwardmost lateral connecting point and the forwardmost medial connecting points, respectively, of the tightening zone, and connecting points 26, 34 are the rearwardmost lateral connecting point and the rearwardmost medial connecting points, respectively, of the tightening zone. As is evident from FIG. 1, the tightening zone is a front tightening zone and is contained within an area forward of the ankle region of the shoe.

Figure 3:
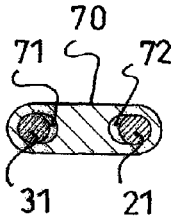
FIG. 3 is a cross-section along the line of FIG. 2.

As shown in FIG. 3, each connector 46, 47, 48, 49 includes a body 70 that has a through opening for passage of each of the lace strands with which it is connected. In this case, for example, the body 70 of the third connector 48 is traversed by a first opening 71 and a second opening 72 that guide the first medial lace strand 31 and the first lateral lace strand 21, respectively. Each opening 71, 72 is an individual tubular opening that extends through the body 70. Each tube 71, 72 has a cross-section that is greater than or equal to that of the lace. The tubular openings 71, 72 are substantially located in the same plane, and are concave in order to provide a regular path for the lace strand. However, in an alternative embodiment, the tubular openings 71, 72 could be straighter. The body 70 can be made of a plastic material or a metallic material. The body 70 constitutes a keeper that is movable, that is, that is not affixed to the upper.

Given that the lace strands 21, 31, 61 slide within their respective keepers 23, 24, 25, 33, 34, 63, and that the lace strands 21, 31, 61 also slide within the connectors 46, 47, 48, 49, the tensions in the three strands are easily balanced within the entire tightening device 20. If the fasteners 22, 26, 32, 62 and the keepers 23, 24, 25, 33, 34, 63 are affixed to the lateral quarter 12 or to the medial quarter 13 of the upper 3, the connectors 46, 47, 48, 49 are movable with respect to the upper 3 along the direction where they are not affixed to the upper. The connectors 46, 47, 48, 49 can move closer to or away from a quarter 12, 13, or they can move longitudinally closer to or away from the tip 5. The connectors can also move along the height of the shoe, by coming closer to or moving away from the sole. In fact, each lace strand 21, 31, 61 passes alternately through fixed keepers 23, 24, 25, 33, 34, 63 affixed to the upper and through keepers 46, 47, 48, 49 that are movable with respect to the upper.

Due to this movability, the connectors 46, 47, 48, 49 are naturally in a position for balancing the tensions among the strands 21, 31, 61 and, therefore, for adapting initially to the foot morphology, for a static tightening mode, and adapting to the variations in the shape of the foot, for a dynamic tightening mode. The positioning varies during a walking cycle. The various loops 40, 41, 42, 42, 44, 45, 65 alternately expand or narrow during the cycle. Because the tensions of the strands are balanced, no portion of the supported foot is overly tight or overly loose.

A resulting advantage is a more uniform holding of the foot and better adaptation to the morphology in both static and dynamic modes, compared to footwear of the prior art.

Moreover, the tightening of the device 20 is achieved by exerting a traction force in the direction of the arrows F1, F2 on the portion 55 of the first medial strand 31 and on the portion 64 of the second medial strand 61, which strand portions, or free ends, extend beyond the tightening zone of the shoe. The tightening can be maintained by any appropriate means known in the art, such as by tying the lace end portions, by the use of a lace blocking mechanism like those disclosed in the documents FR 2 706 743 or U.S. Pat. No.

5,477,593, or by another appropriate device. In addition, the number of keepers can be modified within the scope of the invention.

Other embodiments of the invention are described hereinafter with reference to FIGS. 4-11.

For reasons of convenience, generally only the differences with respect to the first embodiment are described.

Figure 4:
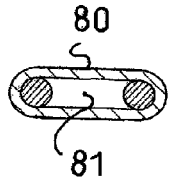
FIG. 4 is similar to FIG. 3, according to a second embodiment of the invention.

The second embodiment is shown in FIG. 4. It merely relates to a change in the structure of the connectors 46, 47, 48, 49 of the first embodiment. In the second embodiment, at least one of the connectors includes a hollowed body 80 to allow the lace strands to extend therethrough. In this case, the body 80 is traversed by an opening 81 provided to guide a plurality of lace strands, such as two strands, for example. The opening 81 can have a constant cross-section to facilitate its manufacture by means of a die, for example. Alternatively, the opening 81 can have a variable cross-section. In this case, the ends can be flared out with respect to the narrower center. The variable cross-section offers a guiding surface whose curvature is similar to that of the loops of the lace strands.

Figure 5:
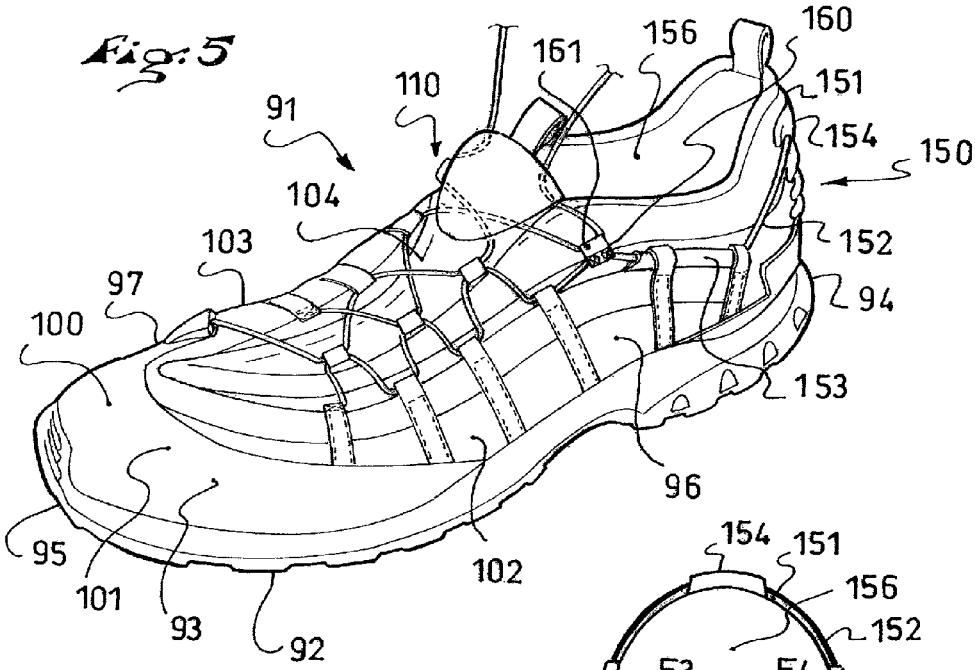
FIG. 5 is a front perspective view of a shoe according to a third embodiment of the invention.
Figure 6:
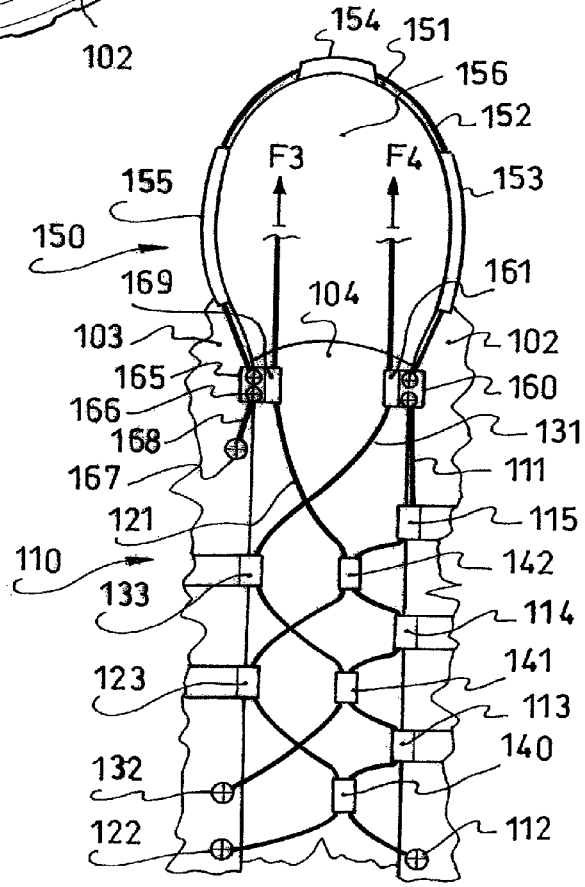
FIG. 6 is a partial schematic top view of the shoe according to FIG. 5.

The third embodiment is shown in FIGS. 5 and 6.

As in the first embodiment, a shoe 91 in this embodiment has a walking sole 92, an upper 93, a heel 94, a tip 95, a lateral side 96, and a medial side 97.

As shown in FIG. 5, the shoe 91, like shoe 1 of FIG. 1, has a low upper which includes a portion 100 for surrounding the foot, a top portion 101, a lateral quarter 102, a medial quarter 103, and a tongue 104.

The shoe 91 further includes a first tightening device 110. This device, similar to that of the first embodiment, has a first lateral lace strand 111, as well as a first fastener 112 and three keepers 113, 114, 115. The tightening device 110 also includes a first medial lace strand 121, as well as a first fastener 122 and a keeper 123. The tightening device 110 further includes a second medial lace strand 131, as well as a first fastener 132 and a keeper 133.

The first tightening device 110 also includes three connectors 140, 141, 142 for connecting the strands to one another.

Like the first embodiment, the shoe 91 includes a tightening zone (i.e., a front or first tightening zone) defined by the lateral connecting points 112, 113, 114, 115, the medial connecting points 122, 132, 123, 133, and the movable connectors 140, 141, and 142, with the tightening of the front of the upper being achieved, as explained below, by application of a traction force in the directions F3, F4 applied to the portions of the lace strands 121, 131 that are located outside of, or beyond, the front tightening zone.

Unlike the first embodiment of the invention, the shoe 91 according to the second embodiment further has a second tightening device 150. This tightening device 150 is adapted to reversibly tighten the seat 151 of the shoe 91. The seat 151 is the portion of the shoe that is adapted to receive the use's heel, sometimes referred to as a heel seat.

The second tightening device 150 includes a lace strand 152 that extends around the seat 151. Thus, the lace 152 extends along the lateral quarter 102, then the heel 94 and, finally, the medial quarter 103. A lateral guide 153, a rear guide 154, and a medial guide 155 are provided for guiding the lace 152 around the seat 151. Each of the guides 153, 154, 155 can be made as a unitary element or in several associated portions, which are juxtaposed or spaced apart. In any case, a guide 153, 154, 155 imposes its trajectory on the lace 152.

The lateral guide 153 and the medial guide 155, in a non-limiting manner, are closer to the sole 92 than the rear guide 154. Thus, the tightening of the lace 152 causes the forward bending of the heel 4 at the same time as a reduction in the area of the inlet 156 of the shoe 91, which receives the foot.

According to the third embodiment of the invention, the first tightening device 110 and the second tightening device 150 are coupled.

A lateral connector 160 connects the first lateral lace strand 111 of the first device 110 to the lace strand 152 of the second device 150. In fact, the strands 111, 152 are both fastened to the connector 160, which is not affixed to the upper 93. The connector 160 also includes a keeper 161 through which the second medial lace strand 131 passes.

In the same context, a medial connector 165 is connected to the upper 93 by a connector having two fasteners 166, 167 and a third medial lace strand 168. The latter is very short and provides the medial connector 165 with a certain freedom of orientation and positioning with respect to the upper.

The lace strand 152 of the second device 150 is fastened to the medial connector 165, which also includes a keeper 169 through which the first medial lace strand 121 passes.

The coupling of the two tightening devices 110, 150 makes it possible to simultaneously tighten the top portion 101 of the upper, in the area of the tongue 104, and in the area of the heel seat 151. A traction on the first medial lace strand 121 and of the second medial lace strand 131 in the direction of the arrows F3, F4 generates, not only the tightening of the first device 110, as explained for the first embodiment, but also the tightening of the second device 150. Indeed, the forces F3, F4 generate traction forces on the first lateral lace strand 111. Consequently, the lace strand 152 of the second device is tensioned.

Here again, the tightening state of the shoe can be maintained by any known device or expedient. One advantage of the third embodiment is in obtaining an overall tightening with two lace strands. The invention also encompasses the separation of the two tightening devices 110 and 150.

Figure 7:
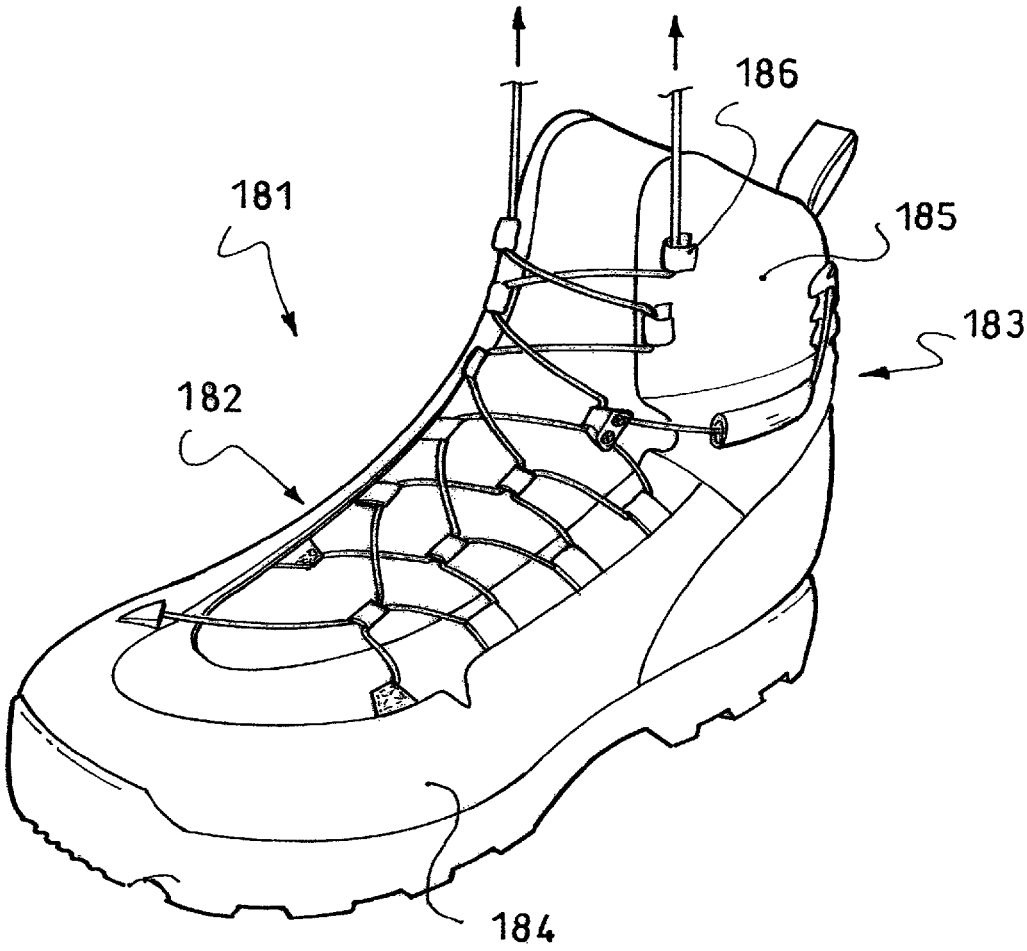
FIG. 7 is a perspective front view of a shoe according to a fourth embodiment of the invention.

The fourth embodiment is shown in FIG. 7.

As in the third embodiment, the boot 181 has a first tightening device 182 and a second tightening device 183. Like aforementioned embodiments, for the first tightening device 182, a front tightening zone is defined by means of the various connectors and connecting points. The particularity of this shoe 181 is that the upper is a high upper, i.e., having a low upper portion 184 and a high upper portion 185. Keepers 186 are arranged on the high portion 185 to extend the range of action of the first tightening device 182.

Figure 8:
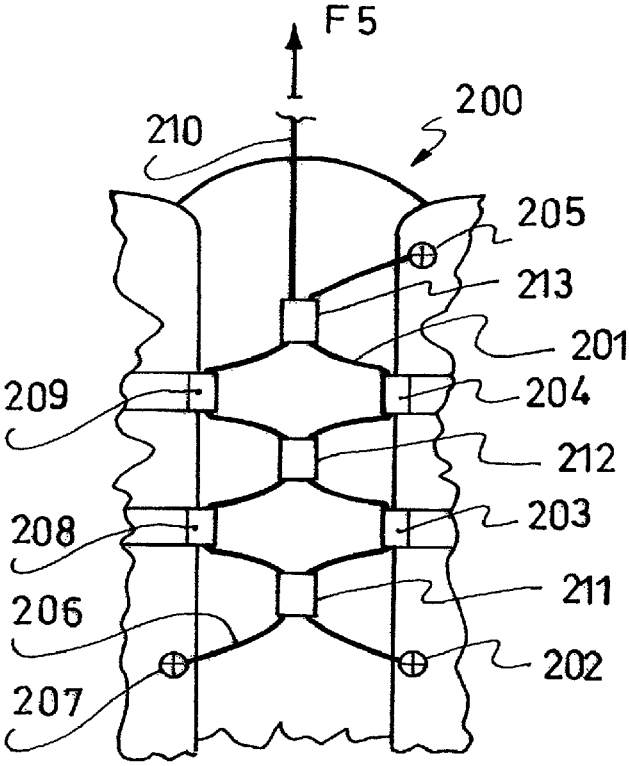
FIG. 8 is a partial schematic top view of a shoe according to a fifth embodiment of the invention.

The fifth embodiment, shown in FIG. 8, provides a simplified first tightening device 200.

The device 200 includes a first lateral lace strand 201 that follows a path extending successively via a first fastener 202, two keepers 203, 204, and a second fastener 205. The device 200 also includes a first medial lace strand 206, which extends from a first fastener 207, is guided by two keepers 208, 209, and has but one free end 210 extending from the tightening zone. Three connectors 211, 212, 213 connect the strands 201, 206 to one another between the keepers. It suffices to pull on the free end 210 in the direction of the arrow F5 to tighten the device 200. A particularity of this embodiment is in achieving a tightening of the article of footwear by the application of a traction force on a single medial lace strand 206. Indeed, the first lace strand 201 is in fact used to form the keeper with a variable geometry, whereas the first medial lace strand 206 serves to exert the tightening by traction on its free end 210. In various embodiments disclosed and illustrated, the lacing system according to the invention can comprise one but no more than two free ends or lace strand portions for applying and maintaining a tightening force on the upper. FIG. 2, e.g. employs two such lace strand portions 55, 64, whereas FIG. 8, e.g., employs one such lace portion.

Within the scope of the invention, a different number of keepers and connectors can be provided.

Figure 9:
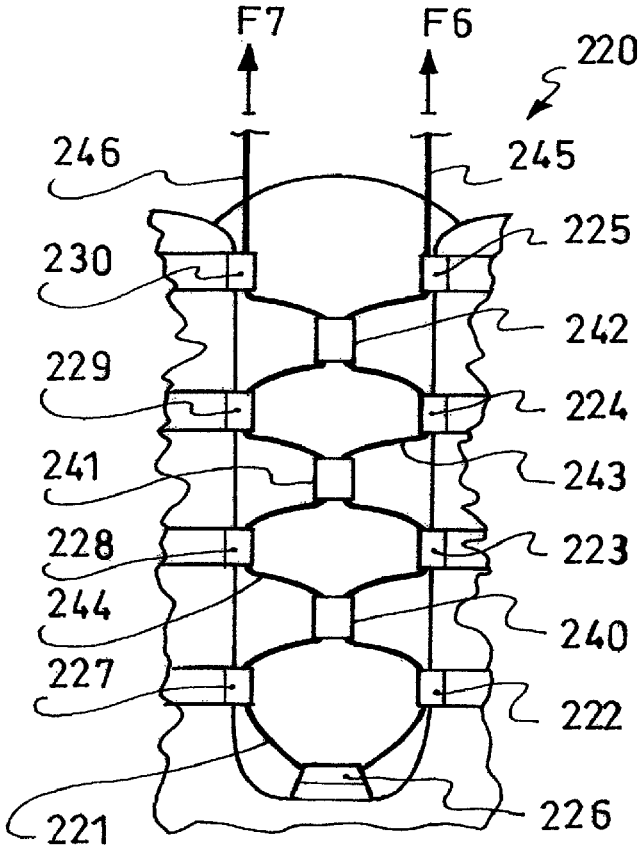
FIG. 9 is a partial schematic top view of a shoe according to a sixth embodiment of the invention.

The sixth embodiment, directed to another simplified first tightening device 220, is shown in FIG. 9.

The device 220 includes a single lace 221 having a lateral strand and a medial strand, four lateral keepers 222, 223, 224, 225, a front keeper 226, and four medial keepers 227, 228, 229, 230. In the sense that the lateral and medial strands collectively consist of a single lace, i.e., lace 221, the lateral strand and the medial strand, collectively, can have no more than two ends. The lace 221, by its lateral and medial strands, respectively, passes successively through the four lateral keepers 222, 223, 224, 225, through the front keeper 226, and then through the four medial 227, 228, 229, 230. Three connectors 240, 241, 242 connect a lateral subdivision 243 and a medial subdivision 244 of the lace 221 to one another between the keepers. A lateral end 245 and a medial end 246 of the lace 221 make it possible to tighten the device 220 by applying a traction force in the direction of the arrows F6, F7. Compared to the previous embodiments, the lace 221 is only used for tightening and does not form any keeper movable along a quarter of the upper, the only movable elements being the movable connectors.

Here again, the number of keepers and connectors can be different.

The seventh embodiment, shown in FIG. 10, also provides a simplified first tightening device 260.

The device includes a single lace 261, as well as a first lateral fastener 262 located close to the inlet of the shoe, three lateral keepers 263, 264, 265, a front keeper 266, and four medial keepers 267, 268, 269, 270. The lace 261 follows a path that starts from the lateral fastener 262, then passes successively by the three lateral keepers 263, 264, 265, by the front keeper 266, and then by the four medial keepers 267, 268, 269, 270. Three connectors 280, 281, 282 connect a lateral subdivision 283 and a medial subdivision 284 of the lace 261 to one another between the keepers. A medial end 285 of the lace 261 makes it possible to tighten the device 260 by applying a traction force in the direction of the arrow F8. The difference, with respect to the embodiment of FIG. 9, is that the tightening is carried out by traction on a single end 285 of the lace 261, due to the fact that the other end is fixed by the first fastener 262.

Once again, the number of keepers and connectors can be different.

The eighth embodiment, shown in FIG. 11, provides a first tightening device 300, which is equivalent to that of the first embodiment.

The first tightening device 300 includes a first lateral lace strand 301, a first lateral fastener 302, three lateral keepers 303, 304, 305, and a second lateral fastener 306. The tightening device 300 further includes a first medial lace strand 311, a first medial fastener 312, a first medial keeper 313, and a second medial keeper 314 for the first medial strand 311, as well as a second medial lace strand 321, a first medial fastener 322, and a first medial keeper 323 for the second medial strand 321.

Four connectors 330, 331, 332, 333 connect the lateral lace 301 with the first medial lace 311, or with the second medial lace 321, in a context similar to that of the first embodiment.

The particularity of the connectors, according to the eighth embodiment, resides in their structure. Each of the connectors 330, 331, 332, 333 is formed by the passage of one strand 301, 311, 321 around the other. In other words, the two medial laces 311, 321 serve to carry out the tightening of the article of footwear, whereas the lateral lace 301 serves to form the lateral keeper with a variable geometry and movable connectors. The strands slide with respect to one another in order to balance the tension forces in the devices 300. Each strand can possess or be coated with a material having low friction coefficient to facilitate the sliding. Polyethylene, for example, is suitable, at least on the surface of the strand.

Like embodiments described above, each of those illustrated in FIGS. 8-11 includes a front tightening zone defined by the various connectors and connecting points for the lace strands.

In any event, the invention is embodied from materials and according to manufacturing techniques that are known to those with ordinary skill in the art.

The invention is not limited to the particulars of the embodiments described hereinabove; it includes all of the technical equivalents that fall within the scope of the claims that follow.

In particular, the architecture of a tightening device can, in any case, be reversed, in the sense that the particular features related to the medial side can also be found on the lateral side, and vice versa. For example, FIG. 2*b* shows an embodiment that has the reverse architecture of that of the embodiment of FIGS. 1 and 2, whereby forces in the directions F1*a*, F2*a* are applied to two lateral lace portions rather than to two medial lace portions. More specifically, the embodiment of FIG. 2*b* shows a device for tightening the upper that includes a first lateral strand, a second lateral strand, and a single medial strand. In such "reversed" embodiment, as illustrated in FIG. 2*b*, therefore, there are at least two connecting points connecting the second lateral lace strand to the lateral quarter, the second lateral lace strand including a lateral intermediate portion extending between the two connecting points of the second lateral lace strand. The above-mentioned description of FIGS. 1 and 2 relating to the specific arrangements of first, second, third, fourth, and fifth connecting points with the first and second medial lace strands and first lateral lace strand is then reversed with respect to the embodiment of FIG. 2*b*, which employs first and second lateral lace strands and a first medial lace strand.

The invention also encompasses a construction in which keepers with a variable geometry are formed with lace strands on each of the lateral and medial sides, respectively, of the article of footwear, in addition to the movable connectors.

A tightening device can be centered transversely with respect to the upper, or offset from the center toward the lateral side or toward the medial side.

A device can be rectilinear, or can form transverse undulations.

The various points for connection, from the tightening device to the upper, can be transversely aligned or offset.

The distances between the connecting points, on the same side of the article of footwear, can be identical or different.

In general, a lace includes at least one strand guided by a succession of lateral keepers or a succession of medial keepers, the strand also being guided by at least one connector, movable relative to the upper, situated between a pair of the succession lateral keepers or between a pair of the succession of medial keepers.

Also, according to the invention, at least one keeper is movable with respect to the upper, i.e., not directly affixed to the upper.

In any case, a lace or a lace strand can include a cord, a string, a strap, a cable, or a filiform shape made of any material. A lace, therefore, can be considered a linkage or a part of a linkage.

In each of the exemplary non-limiting embodiments illustrated or described herein can be characterized as including a lacing system that can include one or more lace strands. In addition, the exemplary lacing system illustrated or described herein can include up to two ends, such as free ends, available for applying and maintaining a tightening force (such as via directions F1-F8) on the upper. A pair of lace strands of the exemplary non-limiting embodiments illustrated or described herein can be said to collectively consist of a single lace (such as the lateral lace strand and the medial lace strand consisting of the single lace 221 of FIG. 9 or the two strands of the single lace 261 of FIG. 10) or fixed to the upper at a connecting point (such as, e.g., at the connecting point, or fastener, 207 of FIG. 8 and the connecting points 22, 26, 32 of FIG. 1, and others).

The invention claimed is:

1. An article of footwear comprising:

an outer sole;

an upper including a lateral quarter and a medial quarter;

a device for tightening the upper, said device comprising:

a lacing system comprising a first lateral lace strand and a first medial lace strand;

at least two lateral connecting points connecting the first lateral lace strand to the lateral quarter, the first lateral lace strand being slidably guided by at least one of said at least two lateral connecting points;

at least two medial connecting points connecting the first medial lace strand to the medial quarter, the first medial lace strand being slidably guided by at least one of said at least two medial connecting points;

said first lateral lace strand including a lateral intermediate portion extending between two of said lateral connecting points without being guided by one of said medial connecting points;

said first medial lace strand including a medial intermediate portion extending between two of said medial connecting points without being guided by one of said lateral connecting points;

at least one connector connecting the lateral intermediate portion of the first lateral lace strand and the medial intermediate portion of the first medial lace strand;

at least one of the first lateral strand and the first medial strand being slidable relative to said at least one connector;

at least said one connector not being affixed to said upper other than by said connecting of said intermediate portions of the first lateral and medial lace strands;

a tightening zone defined by the following: said at least two lateral connecting points, said at least two medial connecting points and said at least one connector;

said lacing system comprising no more than two lace portions having free lace ends extending beyond said tightening zone for applying and maintaining a tightening force to at least one of the first lateral and first medial lace strands;

the device for tightening the upper further comprising:

a second medial lace strand;

at least two connecting points connecting the second medial lace strand to the medial quarter;

the second medial lace strand including a medial intermediate portion extending between the two connecting points of the second medial lace strand.

2. An article of footwear according to claim 1, wherein:

along a path of the first lateral lace strand, said at least two connecting points comprise:

a plurality of fastening points fixing the first lateral lace strand to the upper; and a plurality of lace keepers;

along a path of the first medial lace strand, said at least two connecting points comprise:

at least one fastening point fixing the first medial lace strand to the upper; and a plurality of lace keepers.

3. An article of footwear according to claim 1, wherein:

along a path of the first lateral lace strand, said at least two connecting points comprise first, second, third, fourth, and fifth successive connecting points, wherein:

the first and fifth connecting points are fastening points fixing the first lateral lace strand to the upper; and the second, third, and fourth connecting points are lace keepers;

along a path of the first medial lace strand, said at least two connecting points comprise first, second, and third successive connecting points, wherein:

the first connecting point is a fastening point fixing the first medial lace strand to the upper; and the second and third connecting points are lace keepers;

along a path of the second medial lace strand, said at least two connecting points comprise first and second successive connecting points, wherein:

the first connecting point is a fastening point fixing the second medial lace strand to the upper; and the second connecting point is a lace keeper.

4. An article of footwear according to claim 1, further comprising:

a second device for tightening the upper comprising a tightening device for tightening a heel seat of the article of footwear.

5. An article of footwear according to claim 4, wherein:

the first tightening device and the second tightening device are coupled.

6. An article of footwear according to claim 1, wherein:

said at least two connecting points connecting the first lateral strand to the lateral quarter includes first and second fastening points fixing the first lateral strand to the upper and two successive lace keepers between said first and second fastening points along a path of the first lateral strand;

said at least two connecting points connecting the first medial strand to the medial quarter includes a first fastener and two successive lace keepers extending away from said first fastener along a path of the first medial strand;

said first medial strand having a free end extending from said two successive lace keepers;

said at least one connector comprises three connectors connecting together the first lateral strand and the first medial strand between said lace keepers of said first lateral strand and said first medial strand.

7. An article of footwear according to claim 1, wherein:

the upper is a low upper having an upper edge adapted to extend at or below an ankle of a wearer, the upper having no high portion along a lower leg of the wearer.

8. An article of footwear according to claim 1, wherein:

the upper is a high upper having a high portion adapted to extend above an ankle of the user.

9. An article of footwear according to claim 1, wherein:

said at least one connector includes a body having two through openings, each of said openings accommodating a respective one of said first lateral and medial lace strands.

10. An article of footwear according to claim 2, wherein:

said at least one connector includes a body having one through opening, said opening accommodating both of said first lateral and medial lace strands.

11. An article of footwear according to claim 1, wherein:
said at least one connector consists of the passage of one of said first lateral and medial lace strands around another of said first lateral and medial lace strands.

12. An article of footwear according to claim 1, wherein:
said lacing system comprises two free ends available for applying and maintaining a tightening force on the upper.

13. An article of footwear according to claim 1, wherein:
the article of footwear includes no tongue between the lateral and medial quarters.

14. An article of footwear comprising:
an outer sole;
an upper including a lateral quarter and a medial quarter;
a device for tightening the upper, said device comprising:
a lacing system comprising a first lateral lace strand and a first medial lace strand;
at least two lateral connecting points connecting the first lateral lace strand to the lateral quarter, the first lateral lace strand being slidably guided by at least one of said at least two lateral connecting points;
at least two medial connecting points connecting the first medial lace strand to the medial quarter, the first medial lace strand being slidably guided by at least one of said at least two medial connecting points;
said first lateral lace strand including a lateral intermediate portion extending between two of said lateral connecting points without being guided by one of said medial connecting points;
said first medial lace strand including a medial intermediate portion extending between two of said medial connecting points without being guided by one of said lateral connecting points;
at least one connector connecting the lateral intermediate portion of the first lateral lace strand and the medial intermediate portion of the first medial lace strand;
at least one of the first lateral strand and the first medial strand being slidable relative to said at least one connector;
at least said one connector not being affixed to said upper other than by said connecting of said intermediate portions of the first lateral and medial lace strands;
a tightening zone defined by the following: said at least two lateral connecting points, said at least two medial connecting points and said at least one connector;
said lacing system comprising no more than two lace portions having free lace ends extending beyond said tightening zone for applying and maintaining a tightening force to at least one of the first lateral and first medial lace strands;
the device for tightening the upper further comprising:
a second lateral lace strand;
at least two connecting points connecting the second lateral lace strand to the lateral quarter;
the second lateral lace strand including a lateral intermediate portion extending between the two connecting points of the second lateral lace strand.

15. An article of footwear according to claim 14, wherein:
along a path of the first medial lace strand, said at least two connecting points comprise:
a plurality of fastening points fixing the first medial lace strand to the upper; and
a plurality of lace keepers;
along a path of the first lateral lace strand, said at least two connecting points comprise:
at least one fastening point fixing the first lateral lace strand to the upper; and
a plurality of lace keepers.

16. An article of footwear according to claim 14, wherein:
along a path of the first medial lace strand, said at least two connecting points comprise first, second, third, fourth, and fifth successive connecting points, wherein:
the first and fifth connecting points are fastening points fixing the first medial lace strand to the upper; and
the second, third, and fourth connecting points are lace keepers;
along a path of the first lateral lace strand, said at least two connecting points comprise first, second, and third successive connecting points, wherein:
the first connecting point is a fastening point fixing the first lateral lace strand to the upper; and
the second and third connecting points are lace keepers;
along a path of the second lateral lace strand, said at least two connecting points comprise first and second successive connecting points, wherein:
the first connecting point is a fastening point fixing the second lateral lace strand to the upper; and
the second connecting point is a lace keeper.

17. An article of footwear according to claim 14, further comprising:
a second device for tightening the upper comprising a tightening device for tightening a heel seat of the article of footwear.

18. An article of footwear according to claim 17, wherein:
the first tightening device and the second tightening device are coupled.

19. An article of footwear according to claim 1, wherein:
said at least two lateral connecting points further comprise a forwardmost lateral connecting point guiding or fastening the first lateral strand, and a rearwardmost lateral connecting point guiding or fastening the first lateral strand;
said at least two medial connecting points further comprise a forwardmost medial connecting point guiding or fastening the first medial strand, and a rearwardmost medial connecting point guiding or fastening the first medial strand;
the tightening zone is contained within an area of the article of footwear forward of an ankle region and is further defined by the forwardmost lateral connecting point, the forwardmost medial connecting point, the rearwardmost lateral connecting point, and the rearwardmost medial connecting point.

20. An article of footwear according to claim 14, wherein:
said at least two lateral connecting points further comprise a forwardmost lateral connecting point guiding or fastening the first lateral strand, and a rearwardmost lateral connecting point guiding or fastening the first lateral strand;
said at least two medial connecting points further comprise a forwardmost medial connecting point guiding or fastening the first medial strand, and a rearwardmost medial connecting point guiding or fastening the first medial strand;
the tightening zone is contained within an area of the article of footwear forward of an ankle region and is further defined by the forwardmost lateral connecting point, the forwardmost medial connecting point, the rearwardmost lateral connecting point, and the rearwardmost medial connecting point.

21. An article of footwear according to claim 1, wherein:

said no more than two lace portions extending beyond said tightening zone comprise no more than two lace portions extending rearwardly beyond said tightening zone.

22. An article of footwear according to claim 14, wherein:

said no more than two lace portions extending beyond said tightening zone comprise no more than two lace portions extending rearwardly beyond said tightening zone.

23. An article of footwear according to claim 1, wherein:

said first lateral lace strand not being guided by a medial connecting point or said first medial lace strand not being guided by a lateral connecting point.

24. An article of footwear according to claim 14, wherein:

said first lateral lace strand not being guided by a medial connecting point or said first medial lace strand not being guided by a lateral connecting point.

25. An article of footwear according to claim 14, wherein:

said at least two connecting points connecting the first lateral strand to the lateral quarter includes first and second fastening points fixing the first lateral strand to the upper and two successive lace keepers between said first and second fastening points along a path of the first lateral strand;

said at least two connecting points connecting the first medial strand to the medial quarter includes a first fastener and two successive lace keepers extending away from said first fastener along a path of the first medial strand;

said first lateral strand having a free end extending from said two successive lace keepers;

said at least one connector comprises three connectors connecting together the first lateral strand and the first medial strand between said lace keepers of said first lateral strand and said first medial strand.

26. An article of footwear according to claim 14, wherein:

the upper is a low upper having an upper edge adapted to extend at or below an ankle of a wearer, the upper having no high portion along a lower leg of the wearer.

27. An article of footwear according to claim 14, wherein:

the upper is a high upper having a high portion adapted to extend above an ankle of the user.

28. An article of footwear according to claim 14, wherein:

said at least one connector includes a body having two through openings, each of said openings accommodating a respective one of said first lateral and medial lace strands.

29. An article of footwear according to claim 14, wherein:

said at least one connector includes a body having one through opening, said opening accommodating both of said first lateral and medial lace strands.

30. An article of footwear according to claim 14, wherein:

said at least one connector consists of the passage of one of said first lateral and medial lace strands around another of said first lateral and medial lace strands.

31. An article of footwear according to 14, wherein:

said lacing system comprises two free ends available for applying and maintaining a tightening force on the upper.

* * * * *